US010152902B2

(12) United States Patent
Stusser

(10) Patent No.: US 10,152,902 B2
(45) Date of Patent: Dec. 11, 2018

(54) CARD THAT STANDS PERPENDICULAR TO A HORIZONTAL SURFACE

(71) Applicant: Daniel Irwin Stusser, Olympia, WA (US)

(72) Inventor: Daniel Irwin Stusser, Olympia, WA (US)

( * ) Notice: Subject to any disclaimer, the term of this patent is extended or adjusted under 35 U.S.C. 154(b) by 0 days.

(21) Appl. No.: 15/372,131

(22) Filed: Dec. 7, 2016

(65) Prior Publication Data

US 2017/0084206 A1 Mar. 23, 2017

Related U.S. Application Data

(63) Continuation-in-part of application No. 14/718,058, filed on May 20, 2015.

(60) Provisional application No. 62/000,675, filed on May 20, 2014.

(51) Int. Cl.

| | |
|---|---|
| ***G09F 1/06*** | (2006.01) |
| ***B42D 15/04*** | (2006.01) |
| ***G09F 1/02*** | (2006.01) |
| ***G09F 1/08*** | (2006.01) |
| ***G09F 1/10*** | (2006.01) |
| ***G09F 1/14*** | (2006.01) |

(52) U.S. Cl.

CPC ..... *G09F 1/06* (2013.01); *B42D 15/042* (2013.01); *G09F 1/02* (2013.01); *G09F 1/08* (2013.01); *G09F 1/10* (2013.01); *G09F 1/14* (2013.01)

(58) Field of Classification Search

CPC ..... B42D 15/04; B42D 15/042; G09F 1/04; G09F 1/06; G09F 1/00; A47F 5/112

See application file for complete search history.

(56) References Cited

U.S. PATENT DOCUMENTS 740,228 A * 9/1903 Carpenter ..... G05G 1/02 40/124.17
1,343,054 A * 6/1920 Hurlbut ..... G09F 1/04 248/459
1,348,899 A 8/1920 Sargent
(Continued)

FOREIGN PATENT DOCUMENTS

CN 203121536 U * 8/2013
JP 2004061835 A * 2/2004

OTHER PUBLICATIONS

Graphics3, Rocking Horse Pop-up Cards—Gift Cards, Catalog ID#: A98131, 2 pages.

*Primary Examiner* — Cassandra Davis
(74) *Attorney, Agent, or Firm* — Alfred M. Walker

(57) ABSTRACT

The present invention is a card that stands perpendicular to a horizontal surface. The card is made up of a single piece of material on which graphic images and letters have been printed and which has been specially shaped and pre-creased to enable a recipient to fold the base part of it so that the display part will rise up perpendicular to or at a raked angle from the horizontal surface on which it is placed. The single piece of material has no removed portions within an external outer edge of the material, capable of forming open apertures; The business/greeting/advertising display card stands upright to a horizontal surface within a line of sight of a viewer. Optionally the straight bottom may have an arcuate surface, capable of making the novelty card oscillate when manually pushed in a rocking side to side motion.

14 Claims, 17 Drawing Sheets

(56) References Cited

U.S. PATENT DOCUMENTS

| | | | | | |
|---|---|---|---|---|---|
| 1,573,767 | A | * | 2/1926 | Hurst | G09F 1/02 40/312 |
| 1,653,188 | A | * | 12/1927 | Marsh | G09F 1/04 40/124.16 |
| 1,725,702 | A | * | 8/1929 | Cubberley | B42F 17/02 211/11 |
| 1,947,521 | A | | 2/1934 | Einson | |
| 2,530,950 | A | | 11/1950 | Ebert et al. | |
| 2,651,862 | A | | 9/1953 | Fine | |
| 2,720,044 | A | * | 10/1955 | Montalto | G09F 1/10 40/649 |
| 2,795,877 | A | * | 6/1957 | Falk | H04M 1/21 40/120 |
| 2,815,597 | A | | 12/1957 | Carter | |
| 2,898,110 | A | * | 8/1959 | Overbaugh | A63B 57/10 229/92.8 |
| 3,077,686 | A | * | 2/1963 | Montalto | G09F 1/10 40/319 |
| 4,246,711 | A | | 1/1981 | Wagner | |
| 5,010,669 | A | | 4/1991 | Moran | |
| 5,582,888 | A | * | 12/1996 | Volkert | B41F 17/02 283/56 |
| 5,943,800 | A | * | 8/1999 | Rose | G09F 1/06 40/124.08 |
| 6,092,317 | A | * | 7/2000 | Volkert | G09F 1/06 40/124.08 |
| 6,568,543 | B1 | * | 5/2003 | Schneider | A47B 65/20 211/42 |
| 8,656,616 | B2 | * | 2/2014 | Ashpole | B42D 15/02 273/317.5 |
| 2009/0320335 | A1 | * | 12/2009 | Thomas | G09F 1/14 40/1 |

* cited by examiner

04

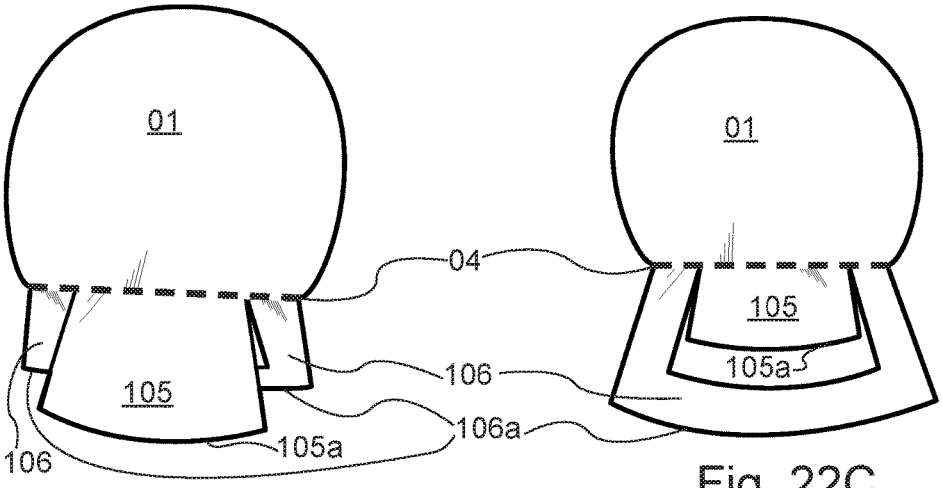
Fig. 22A
Fig. 22C
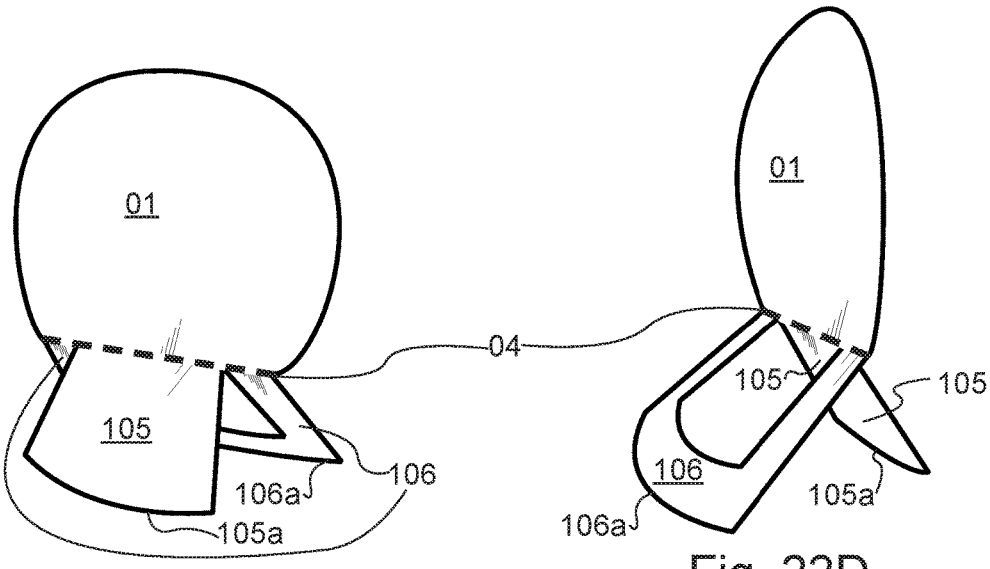
Fig. 22B
Fig. 22D

CARD THAT STANDS PERPENDICULAR TO A HORIZONTAL SURFACE

CROSS REFERENCE TO RELATED APPLICATION

This application claims the benefit under 35 U.S.C. § 119 (e) of provisional patent application No. 62/000,675, filed May 20, 2014. The provisional '675 application is incorporated by reference herein. This application also is a continuation-in-part of application Ser. No. 14/718,058 filed May 20, 2015, and claims priority under 35 U.S.C. § 120 therefrom. The '058 application is incorporated by reference herein.

FIELD OF THE INVENTION

The present invention relates to a novelty business/greeting/advertising display card that has folds and slits to make a standing business/greeting/advertising display card, which is capable of standing upright on a flat surface, such as a desk, table or counter top. The novelty is that it requires only a single piece of cardstock paper, and no need to remove any surface material parts for interior holes. Optionally the straight bottom may have an arcuate surface, capable of making the novelty card oscillate in a rocking side to side motion.

BACKGROUND—PRIOR ART

Prior similar novelty cards articles have been A) more complex, B) more expensive, C) have not been designed to allow for small-size embodiments, D) are difficult to transport in large quantities, and E) are not designed to appeal to specific markets.

The present invention solves these issues.

U.S. Pat. No. 2,898,110 of Overbaugh (1959) discloses a cardboard golf tee which includes a first panel portion with a bottom portion which is bendable to form support legs, but the top portion requires removal of a circular disk of cardstock material which forms a round open aperture capable of holding a spherical golf ball, either snugly firm inside the aperture formed from the removal of a circular disk of material from the device, or else within two hemispherical portions, which are formed by folding the cardstock at the midpoint of the aperture formed from the removal of the circular disk of material (thereby rendering the cardstock of Overbaugh '110 as having a discontinuous portion, where the excess circular disk of material was removed from. Overbaugh '110 also requires serrated edges to grip into grass and turf, and these serrated edges would be a series of points instead of a continuous edge, and therefore might not be stable upon a flat solid surface, such as a desk top, countertop or table top surface.

U.S. Pat. No. 5,943,800 of Rose (1999) discloses a pop-up display amusement card, which requires a plurality of pieces joined together from multiple card stock pieces, with separate fasteners or adhesive connectors.

Both U.S. Pat. No. 1,947,521 to Einson (1934) and U.S. Pat. No. 2,815,597 to Carter (1957) show countertop displays. Both are more complex to manufacture and erect than the present invention, while requiring the construction of an easel. Both require much more display space in their smallest embodiments. In contrast to Einson '21 and Carter '597, the present invention can be made as small as a centimeter square, but is currently made in the size of a conventional business card (2"×3.5") or greeting card (approximately 5"×8") in most situations. It stands unaided by any additional attachment, spar or easel.

One method that allows for the perpendicular display of an image is that shown in U.S. Pat. No. 5,010,669 to Moran (1991) in which a four-panel box has a perforation from which the image can be punched out. In contrast to Moran '669, the present invention uses less than half of the material for a comparable size display and, in most embodiments, requires no punching out of a perforated image within the panels defined by the exterior periphery of the card.

Other single-part cards that are designed to be deployed quickly require specialized structures below them to stand perpendicular. U.S. Pat. No. 4,246,711 (1920) to Sargent and U.S. Pat. No. 2,651,862 (1953) to Fine show simple displays that are designed to be placed on top of long-neck bottles and gable-topped milk cartons, respectively.

U.S. Pat. No. 2,530,950 (1950) to Benchley shows a two-sided display that requires several folds, a slit and a tab to accomplish what the present invention delivers without these complexities.

Currently there are a number of solutions for a card that stands perpendicular to a horizontal surface. Further, there are a number of conventional solutions for bringing attention to printed advertisements. Some of these solutions attempt to bring attention through graphic design or surface treatments, but these solutions fail to meet the needs of industry because these conventional business cards, postcards and other traditional flat advertising pieces are not designed to be displayed easily or viewed repeatedly. Most such pieces are quickly filed away or destroyed. It is desirable for any advertising to offer repetitive exposures for the advertiser.

Since conventional business cards, post cards and other small advertising displays lack any feature of uniqueness once they have been conveyed their greeting, they retain little impact and are often soon discarded. Therefore, there currently exists a need in the advertising industry for a Card that Stands Perpendicular to a Horizontal Surface.

Objects and Advantages:

The present invention delivers the following several objects and advantages over the prior art.

Simplicity:

The present invention enables the recipient of such a piece to easily and quickly display it perpendicular to a counter, desktop or shelf, which in turn makes the advertising message available for many repetitive viewings. The present invention requires no instructions and takes as little as one second to deploy.

It would be desirable to have a business card, rack card, sign or other advertising display, that enables the recipient to display it on a desk, counter or shelf, without the need to use adhesive tape, construct an easel, attach external stands or use fasteners such as nails or tacks.

Price Advantage:

Competitive products, including distinctively printed advertising cards, countertop displays, and promotional products, usually have multiple parts and, accordingly, are usually priced much higher than the present invention.

The present invention is a single part, made of conventional modern materials.

Size Advantage:

The size of the card will vary depending on the rigidity of the material from which it is made, from something as small as a square centimeter to as large will fit through a conventional doorway.

The ratio of the height or surface volume of the display panel of the card to base part(s) will vary according to the need of the advertiser, and The shape of the display panel and base part(s) will vary according to the requirements of the customer.

Simple to Transport:

Non-flat advertising tools, such as countertop displays and promotional products, are often bulky and cannot be easily carried in significant numbers. The present invention is available in various sizes, the smaller of which can be carried by an individual by the hundreds of pieces.

Target Markets:

Other solutions attempt to provide temporary entertainment value or reference information, but these solutions are similarly unable to meet the needs of the industry because they do not solve the problem of how to generate repeated exposures.

This is particularly true for advertising that features a popular image, such as a brand mascot or iconic character, or a portrait of an entertainer, author, speaker or other featured individual.

The present invention advantageously fills the aforementioned deficiencies by providing a novelty card that can be designed in an unlimited number of two-dimensional shapes, including those that emphasize a popular image, such as a brand mascot or iconic character, or a portrait of an entertainer, author, speaker or other featured individual.

The present invention provides a new and unique way for general business advertisers, restaurant businesses, non-profit organizations, sports teams, and celebrities to have a fully customized card that has none of the disadvantages of prior art.

The present invention can be customized in unlimited ways, including as a mailing piece, sales brochure, business card, safety information card, menu, game piece, souvenir, and autograph card.

It is still further an object of the present invention to create a device that is more easily displayed.

Further still, it is an object of the present invention to create a device that leverages the special graphic images of customers.

Other objects will become apparent from the following description of the present invention.

SUMMARY OF THE INVENTION

In keeping with the aforementioned objects and advantages, the present invention includes self-standing novelty business and greeting cards made from a single sheet of cardstock paper having continuous linear or non-linear circumferential edge periphery. While the circumferential periphery edge can be square or rectangular with linear lines, optionally the circumferential edge periphery of the cardstock sheet can have curved, undulating non-linear lines in the form of all or part of the profile of a character associated with the business or greeting card. The single sheet of cardstock paper has no removed internal material portions within the confines of the exterior periphery of the card, capable of forming open apertures within the single sheet of cardstock paper. The single sheet of cardstock paper includes a top continuously extending indicia displaying portion separated from a bottom standing support structure portion by a common linear foldable edge crease. The erect standing of the bottom standing support structure is accomplished by predetermined slits, which are cut along a plurality of edges, such as, for example, three edges, forming slits in the bottom portion of the cardstock sheet. They are then folded along a single top horizontally extending edge crease forming legs spaced apart at distal bottom edges and joined at the top by the horizontally extending folded top edge crease, of the bottom portion of the cardstock sheet. Furthermore, no material is removed from the card other than incidental material along its slit edges of the leg portions.

The present invention is a novelty card that stands perpendicular to a horizontal surface along flat bottom edges of two or three support legs. In an optional alternate embodiment, the flat bottom edges are optionally arcuate, enabling the novelty card to be rocked in a back and forth rocking motion.

The card is made up of a single piece of material on which graphic images and letters have been printed and which has been specially shaped and cut along its periphery edge, and pre-creased to enable a recipient to fold the base part of it, so that the display part will rise up perpendicular to, or at a raked angle from, the horizontal surface on which it is placed.

The present invention is unique in that it is structurally different from other known devices or solutions. More specifically, the present invention is unique due to the presence of:

(1) a crease to enable easy and accurate folding;

(2) a base section designed to enable the main display panel to stand upright;

(3) custom shaping for the display and/or base sections to differentiate the piece from any other advertising cards; and (4) only a simple, single piece of stock, with no need for any adhesives, external stands, instructions or tools with which to assemble it.

Among other things, the present invention provides a card that stands perpendicular to a horizontal surface that does not suffer from any of the problems or deficiencies associated with prior solutions.

The novelty card stands perpendicular to a horizontal surface, and includes:

a) a single sheet of semi-rigid, flexible material, b) the sheet being modified so that at least one crease is added that creates a hinge to differentiate between:

1) a main display panel with a continuous non-cut surface provided within the confines of the main display panel, and 2) a bifurcated base that enables the main display panel to stand perpendicular or raked in perspective to the surface upon which it is placed, The semi-rigid material is at least one of the following materials: paper card stock made of wood fibers, other natural fibers or man-made fibers, plastic card stock, metal plate, metal sheet, metal foil, printable plastic or composite sheets comprising various flexible and rigid materials, or combinations thereof.

The semi-rigid material is printed or imprinted using at least one of the following methods: offset lithography, digital toner printing, xerography, ink jet printing, LED printing, silk screening using ink, paint or dyes, dye sublimation, photographic printing, foil stamping, foil or other imprinting, letterpress, debossing, embossing, laser etching, laser imprinting, laser burning, rubber die imprinting, hand inking, hand painting or ultraviolet coating, or combinations thereof.

The semi-rigid material is creased using of the following technologies: manual creasing, hand creasing, cutting plotter, electric scoring machine, letterpress, die matrix on offset press, cylinder press, rotary die cutting, flexible die, micro-slitting, laser etching, or combinations thereof.

The semi-rigid material is cut to shape using one of the following technologies: hand cutting, digital contour cutting, cutting plotter, dinking, steel-rule die, letterpress, cylinder press, rotary die cutting, flexible die, rotary magnetic cylinder die cutting, laser cutting or extrusion, or combinations thereof.

The semi-rigid material is cut to any size, from as small as one centimeter to as large as the material will allow unsupported standing perpendicular to the surface upon which said card is placed.

Optionally, the card may have a second or additional crease, parallel to the first crease, which is added to the base component to create a flange or foot extending therefrom.

Optionally also, the novelty card may be embedded into a larger sheet of the same semi-rigid material, which is pre-creased but not cut into the shape described by the graphics printed on it. Instead of being cut to shape, there are perforations designed to let the recipient of said piece to punch out the novelty card that stands perpendicular to a horizontal surface, such as a desk top, countertop or table top.

Optionally further, the bottom edges of the card, instead of being straight and horizontally oriented to enable the card to stand perpendicular upon a horizontal surface, the bottoms edges can be arcuate, to enable the novelty card to be rocked by the user's fingertips, in a back and forth, or side to side, amusing motion.

The present invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

BRIEF DESCRIPTION OF THE DRAWINGS

The present invention can best be understood in connection with the accompanying drawings. Closely related figures have the same number but different alphabetic suffixes. It is noted that the invention is not limited to the precise embodiments shown in drawings, in which:

FIGS. 18A, 18B, 18C, 18D, 19A, 19B, 20A, 20B, 21A, 21B, 22A, 22B, 22C and 22D also show the Arcuate Base embodiment of the invention in intended use, as well as in respective perspective, flat front, side edge elevation and top plan views.

DRAWINGS—REFERENCE NUMBERS

01 Display Panel
02 Tripod Base part Lower Display Panel
03 Tripod Base parts Outer Tabs
04 Crease
07 Optional Crease
08 Foot
22 Box-in-Box Base part Inner Box Panel
23 Box-in-Box Base part Outer Box Ring
32 Custom Box Base part Inner Custom Box
33 Custom Box Base part Outer Custom Ring
105 Arcuate Inner Box Support Leg
105*a* Arcuate Bottom Edge of Inner Box Support Leg
106 Arcuate Outer Ring Support Leg
106*a* Arcuate Bottom Edge of Outer Ring Support Leg

DETAILED DESCRIPTION OF THE DRAWINGS

The drawings show examples of said Card from multiple views and in five embodiments. Closely related figures have the same number but different alphabetic suffixes.

DRAWINGS—FIGS.

Figure 1:
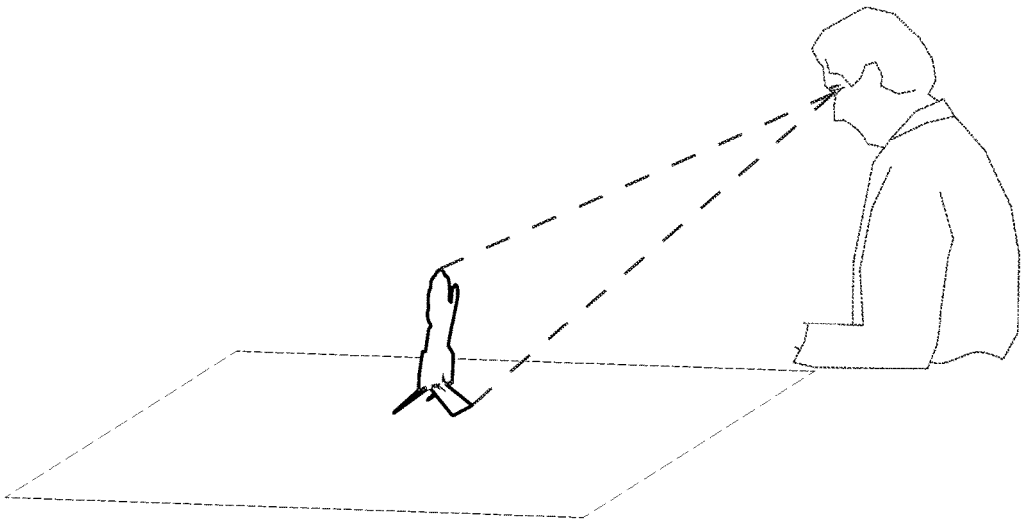
FIG. 1 shows the present invention in its intended use as a close-up advertising tool, whereby the card stands upright to a horizontal support surface within a visual line of sight of a viewer of the card.

FIG. 1 is a perspective view of the present invention, where the user's line of sight of the novelty card is shown in phantom lines for environmental purposes.

Figure 2A:
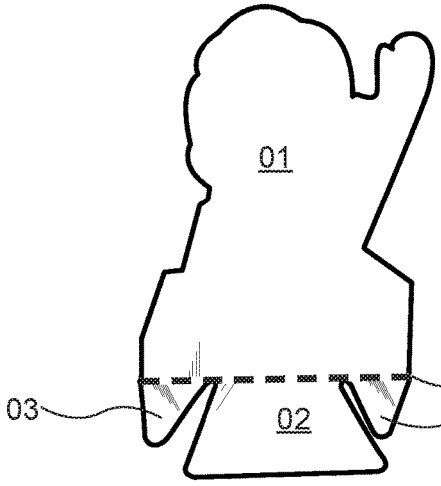
FIGS. 2A, 2B, 2C, 2D, 3A, 3B, 4A, 4B, 4C, 5A, 5B and 5C respectively show the Tripod Base embodiment of the invention in respective flat front, perspective, side edge elevation and top plan views.
Figure 2C:
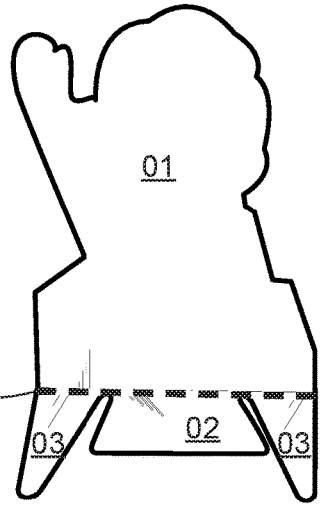
Figure 2B:
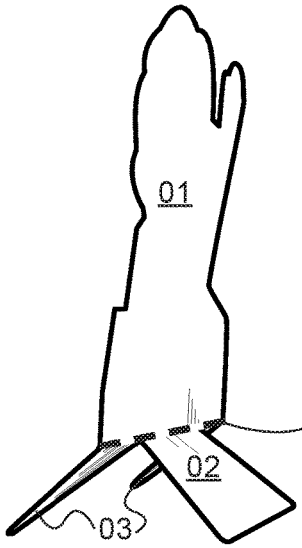
Figure 2D:
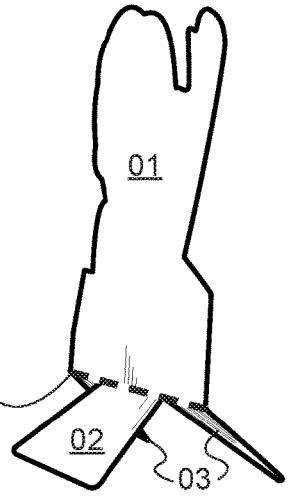

Tripod Base Embodiment:

FIGS. 2A, 2B, 2C and 2D are perspective views that show the Card with a Display Panel 01, Tripod Base parts Lower Display Panel 02 (trapezoid-shaped) and Outer Tabs 03 (triangle-shaped), and crease 04. Crease 04 is shown in the dashed line. FIG. 2A is the obverse side. FIG. 2C is the reverse side. FIGS. 2B and 2D are additional perspective views. These examples are shown as if the card's crease is bent to enable it to stand perpendicular to the surface on which it is placed. While the circumferential periphery edge can be square or rectangular with linear lines, (not shown), optionally the circumferential edge periphery of the cardstock sheet can have curved, undulating non-linear lines in the form of all or part of the profile of a character associated with the business, greeting or advertising display card.

Figures 3A, 3B:
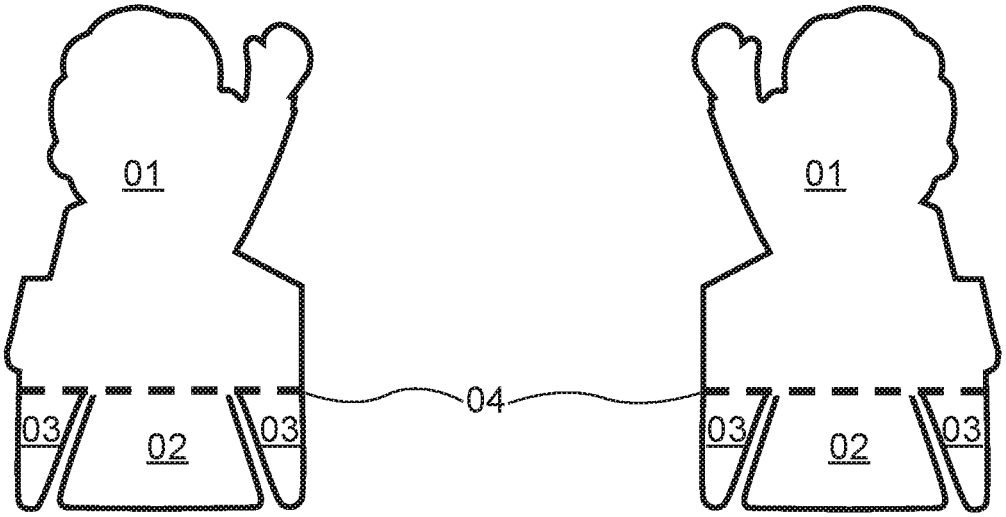
Figure 3C:
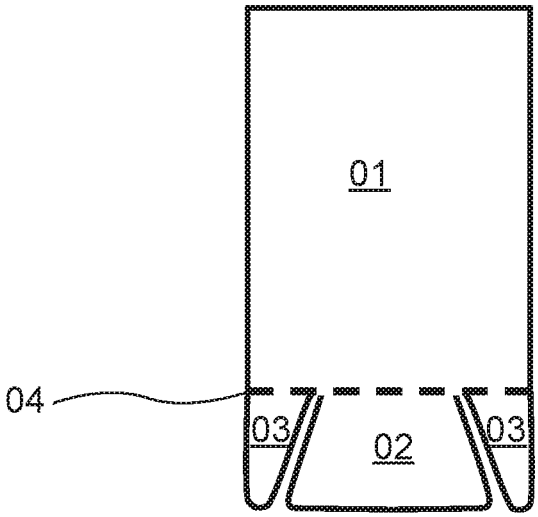
FIG. 3C shows an alternate embodiment where instead of the edge periphery of the card has curved lines imitating the profile of an iconic figure or character, the top panel of the card is a standard, rectangular card, but the standing base is similar to that of FIGS. 2A, 2B, 2C, 2D, 3A, 3B, 4A, 4B, 4C, 5A, 5B and 5C.

FIGS. 3A and 3B are shown as if laying flat, not folded or standing. FIG. 3A is the obverse side. FIG. 3B is the reverse side. FIG. 3C shows an alternate embodiment where instead of the edge periphery of the card has curved lines imitating the profile of an iconic figure or character, the top panel of the card is a standard, rectangular card, but the standing base is similar to that of FIGS. 2A, 2B, 2C, 2D, 3A, 3B, 4A, 4B, 4C, 5A, 5B and 5C.

Figure 4A:
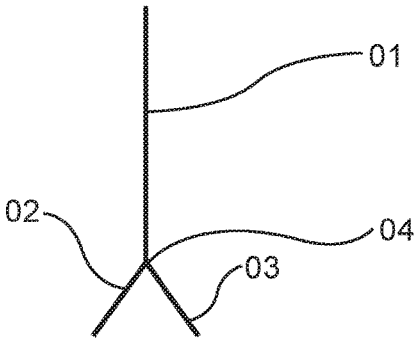
Figure 4B:
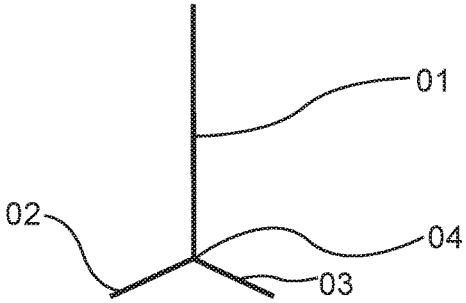
Figure 4C:
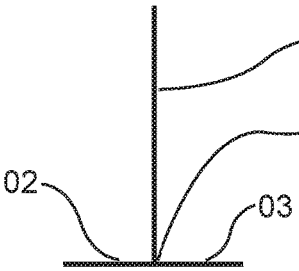

FIGS. 4A, 4B and 4C show elevation views of the card, with its crease folded at three different positions, all of which enable it to stand perpendicular to the surfaces on which it is placed. FIG. 4A shows the Card with the Base at the tallest position, with the Base parts bent at approximately 45 degrees from Display Panel 01. FIG. 4B shows the Base at a middle position, bent at about 75 degrees from Display Panel 01. FIG. 4C shows the Base at a lowest position, with the base parts bent at a 90 degree angle from the display panel, perpendicular to the Display Panel and flat against the surface upon which said Card is displayed.

Figure 5A:
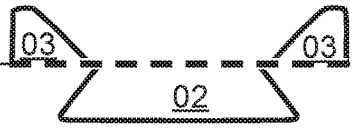
Figure 5B:
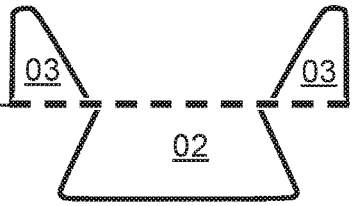
Figure 5C:
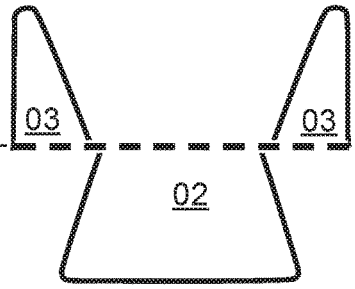

FIGS. 5A, 5B and 5C are top plan views of the same three positions shown in FIGS. 4A, 4B and 4C, but not in the same scale.

Figures 6A, 6B:
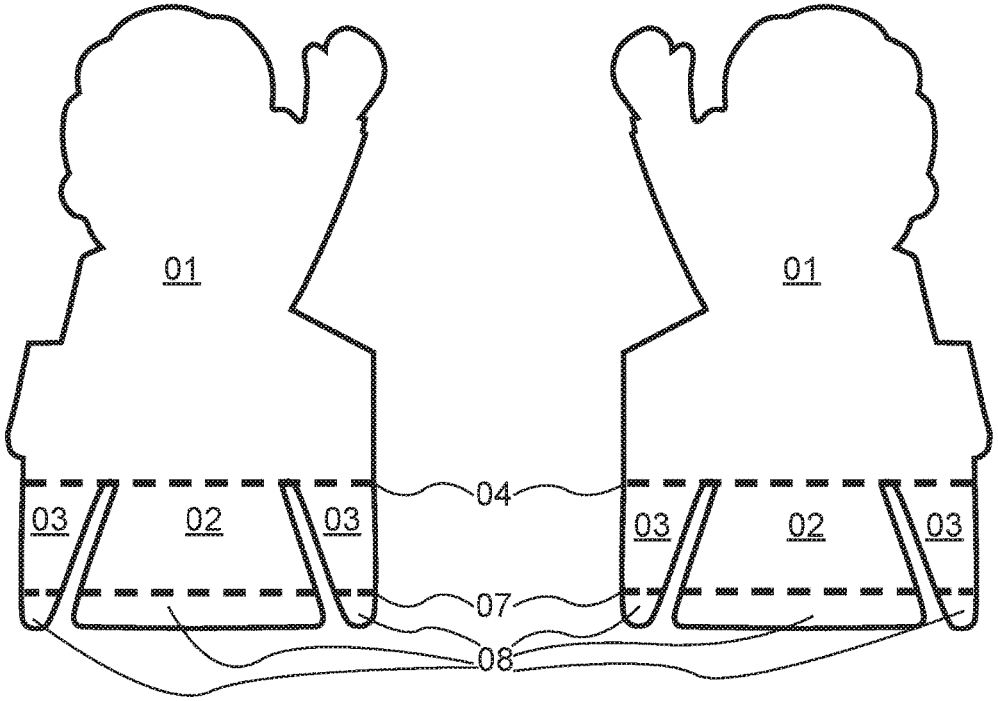
FIGS. 6A, 6B, 7A, 7B, 7C, 8A, 8B and 8C respectively show the Tripod Base embodiment of the invention with an Optional Flange or Foot added in respective flat front elevation, perspective, side edge elevation and top plan views.

Tripod Base Embodiment of the Invention with Optional Flange or Foot:

FIGS. 6A and 6B show the Card as if laying flat, with a Display Panel 01, Tripod Base parts Lower Display Panel 02 (trapezoid-shaped) and Outer Tabs 03 (triangle-shaped), and crease 04. Crease 04 is shown in the dashed line. In addition, part 07 is a second crease and parts 08 create a foot or flange. FIG. 6A is the obverse side. FIG. 6B is the reverse side.

Figure 7A:
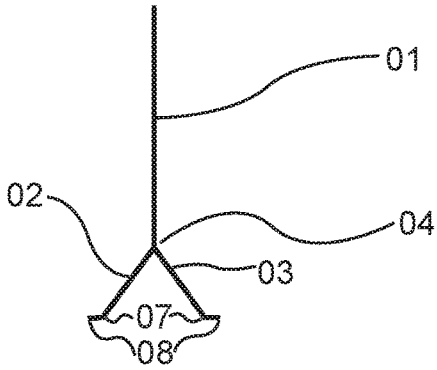
Figure 8A:
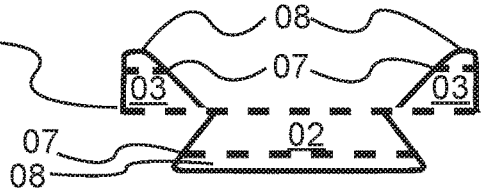
Figure 7B:
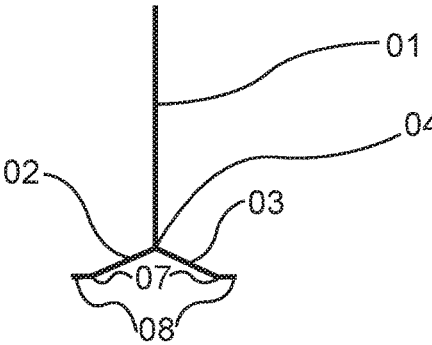
Figure 8B:
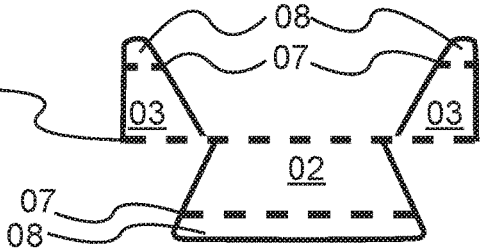
Figure 7C:
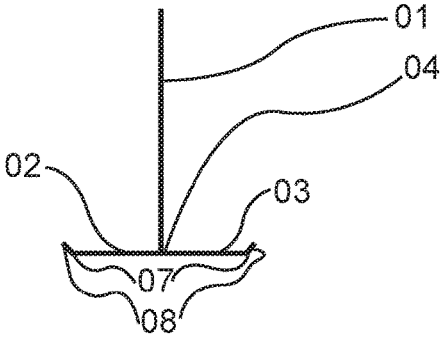
Figure 8C:
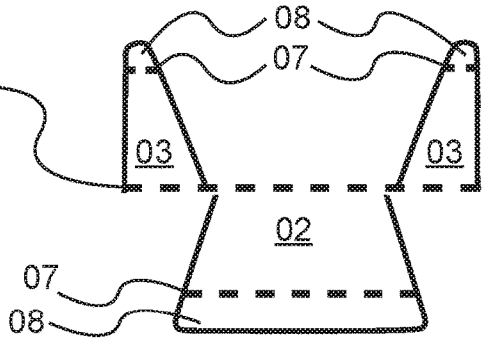

FIGS. 7A, 7B and 7C show elevation views of the card, with its crease folded at three different positions, all of which enable it to stand perpendicular to the surfaces on which it is placed. FIGS. 8A and 8B show Crease 07 is bent so that Foot 08 sits approximately parallel to the surface on which the apparatus is placed. FIG. 8C shows Foot 08 bent but not resting on surface.

FIGS. 8A, 8B and 8C are top plan views of the same three positions shown in FIGS. 7A, 7B and 7C, but not in the same scale. While the circumferential periphery edge can be square or rectangular with linear lines, (not shown), optionally the circumferential edge periphery of the cardstock sheet can have curved, undulating non-linear lines in the form of all or part of the profile of a character associated with the business or greeting card.

In an alternate embodiment where instead of the edge periphery of the card having curved lines imitating the profile of an iconic figure or character, the top panel of the card is a standard, rectangular card, as in FIG. 3C, but the standing base is a tripod base with an optional foot.

Figure 9A:
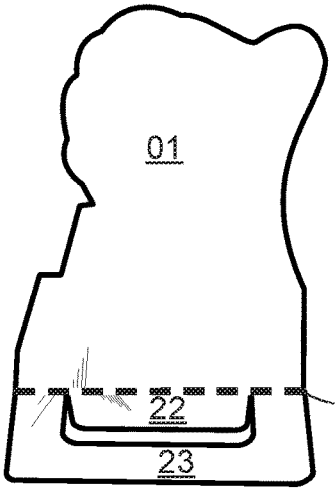
FIGS. 9A, 9B, 9C, 9D, 10A, 10B, 11A, 11B, 12A, 12B respectively show the Box-in-Box Base embodiment of the invention in respective flat front elevation, perspective, side edge elevation and top plan views.
Figure 9C:
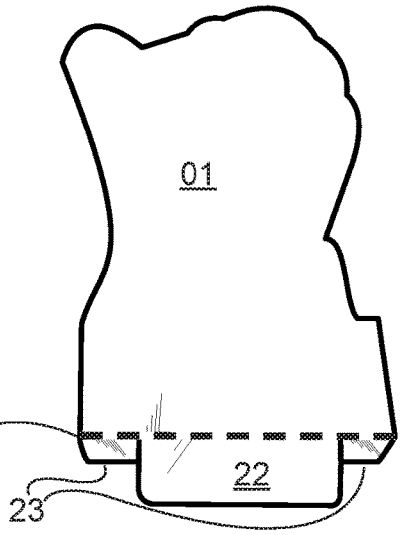
Figure 9B:
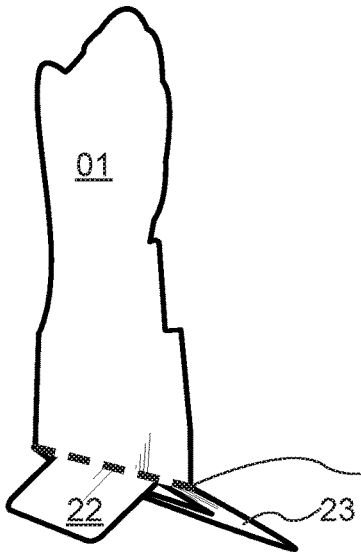
Figure 9D:
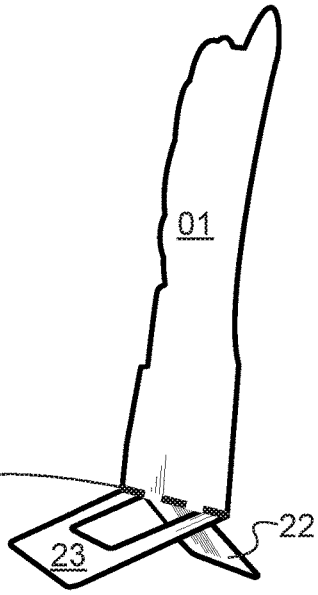

Box-in-Box Embodiment:

FIGS. 9A, 9B, 9C and 9D are perspective views that show the Card with a Display Panel 01, Box-in-Box Base parts including an Inner Box Panel 22 and an Outer Box Ring 23. Crease 04 is shown in the dashed line. FIG. 9A is the obverse side. FIG. 9C is the reverse side. FIGS. 9B and 9D are additional perspective views. These examples are shown as if the card's crease is bent to enable it to stand perpendicular to the surface on which it is placed.

Figures 10A, 10B:
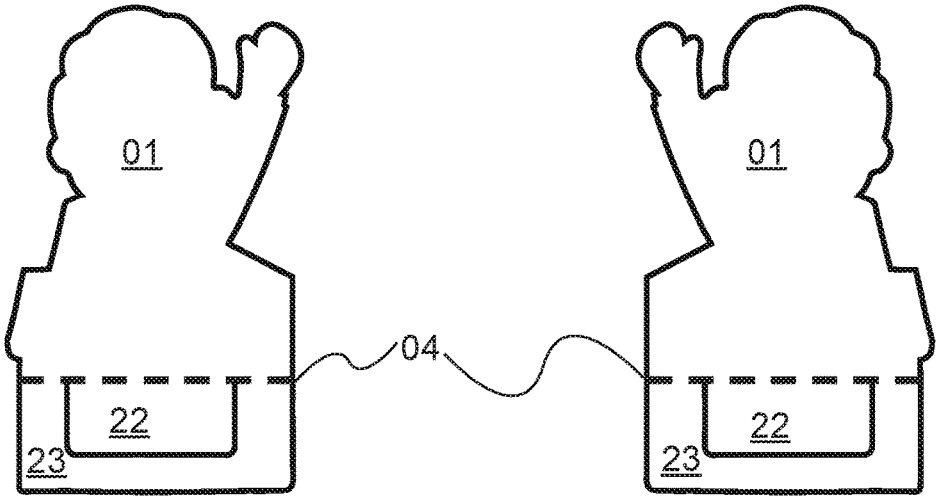

FIGS. 10A and 10B are shown as if laying flat, not folded or standing. FIG. 10A is the obverse side. FIG. 10B is the reverse side.

Figure 11A:
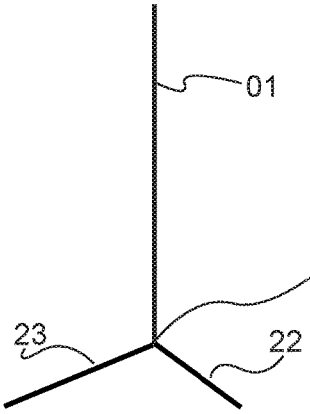
Figure 11B:
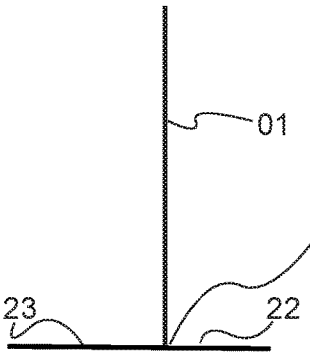

FIGS. 11A and 11B show side elevation views of the card, with its crease folded at two different positions, both of which enable it to stand perpendicular to the surfaces on which it is placed. FIG. 11A shows the Card with the Base at the tallest position, with the Base parts bent at different angles from each other and Display Panel 01. FIG. 11B shows the Base at a lowest position, with the base parts bent at a 90 degree angle from Display Panel 01, perpendicular to Display Panel 01 and flat against the surface upon which the Card is displayed.

Figure 12A:
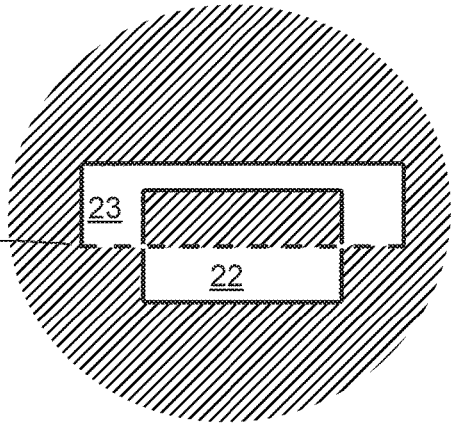
Figure 12B:
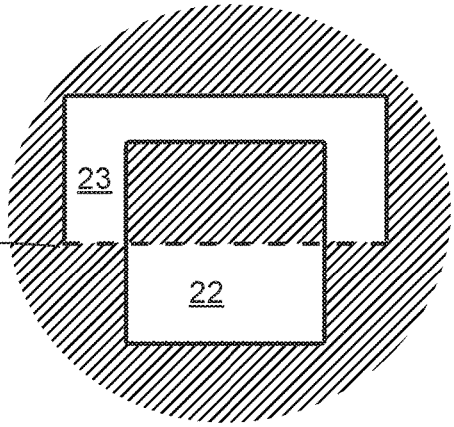

FIGS. 12A and 12B are top plan views of the same positions shown in FIGS. 11A and 11B, but not in the same scale. The shaded area represents the surface upon which the Card is placed and shows the hollowed out area that is exposed when the Inner Box Panel 22 is bent in opposition to the Outer Box Ring 23. While the circumferential periphery edge of the card can be optionally square or rectangular with linear lines, as shown in FIG. 3C, in FIGS. 9A, 9B, 9C, 9D, 10A and 10B the circumferential edge periphery of the cardstock sheet can have curved, undulating non-linear lines in the form of all or part of the profile of a character associated with the business or greeting card.

In this alternate optional embodiment, where instead of the edge periphery of the card having curved lines imitating the profile of an iconic figure or character, the top panel of the card is a standard, rectangular card, as in FIG. 3C, the standing base is a still a box in box base.

Figure 13A:
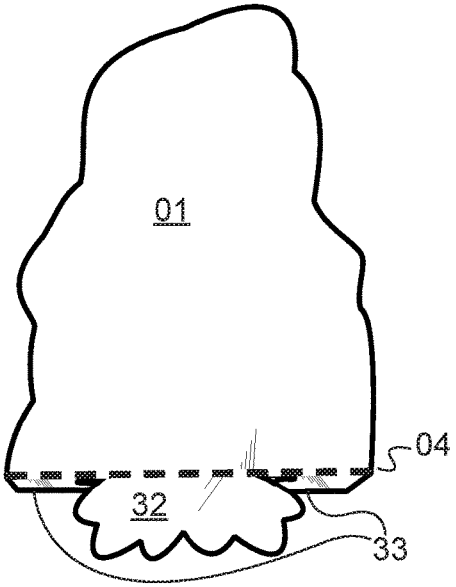
FIGS. 13A, 13B, 13C, 13D, 14A, 14B, 15A, 15B, 16A and 16B respectively show the Custom-Box Base embodiment of the invention in respective perspective, flat front, side edge elevation and top plan views.
Figure 13C:
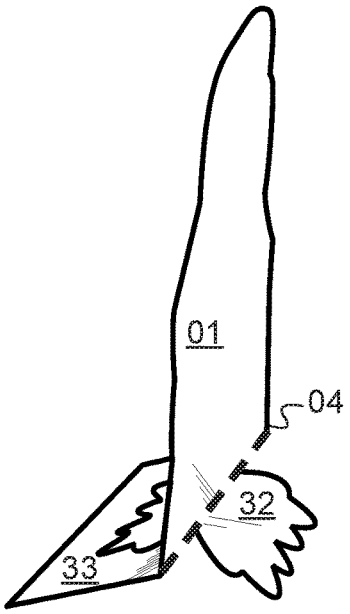
Figure 13B:
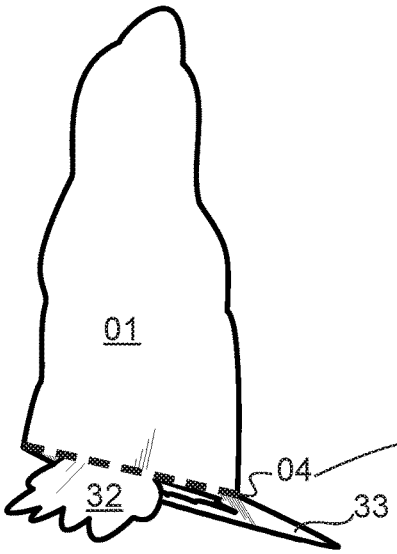
Figure 13D:
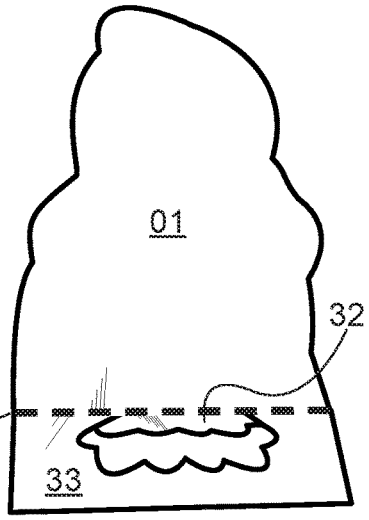

Custom-Box Embodiment:

FIGS. 13A, 13B, 13C and 13D are perspective views that show the Card with a Display Panel 01, Custom-Box Base parts, including an Inner Box Panel 32 and an Outer Box Ring 33. Crease 04 is shown in the dashed line. FIG. 13A is the obverse side. FIG. 13D is the reverse side. FIGS. 13B and 13C are additional perspective views. These examples are shown as if the card's crease is bent to enable it to stand perpendicular to the surface on which it is placed.

Figures 14A, 14B:
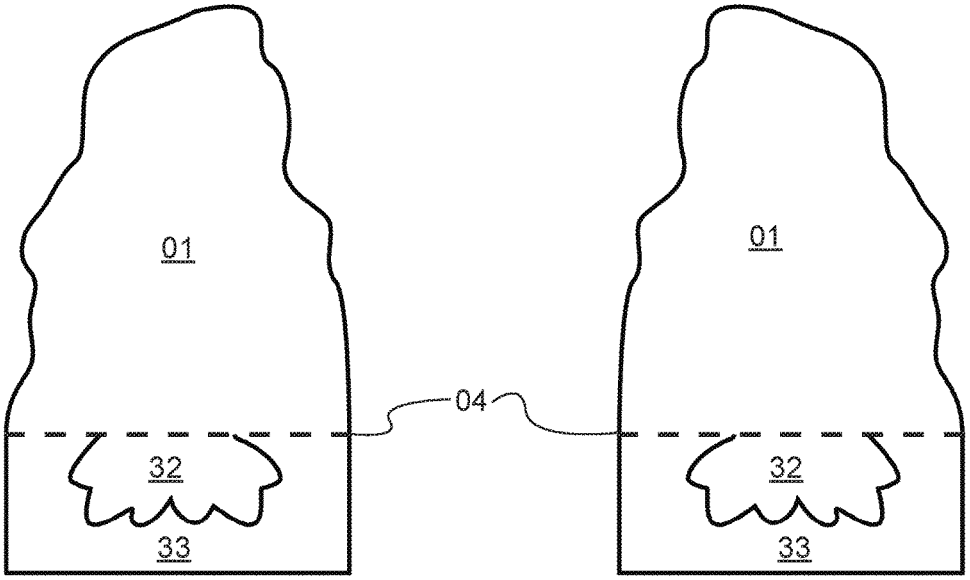

FIGS. 14A and 14B are shown as if laying flat, not folded or standing. FIG. 14A is the obverse side. FIG. 14B is the reverse side.

Figure 15A:
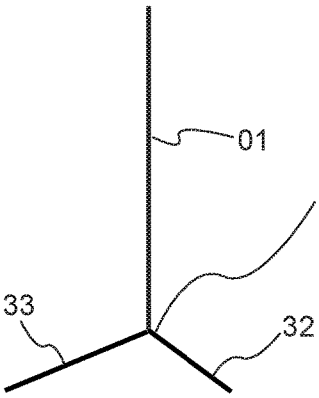
Figure 15B:
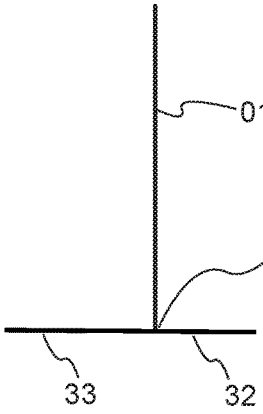

FIGS. 15A and 15B show elevation views of the card, with its crease folded at two different positions, both of which enable it to stand perpendicular to the surfaces on which it is placed. FIG. 15A shows the Card with the Base at the tallest position, with the Base parts bent at different angles from each other and Display Panel 01. FIG. 15B shows the Base at a lowest position, with the base parts bent at a 90 degree angle from Display Panel 01, perpendicular to Display Panel 01 and flat against the surface upon which said Card is displayed.

Figure 16A:
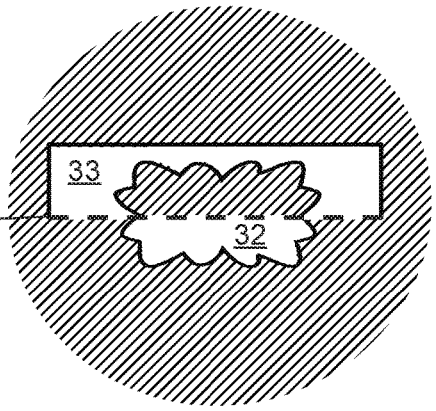
Figure 16B:
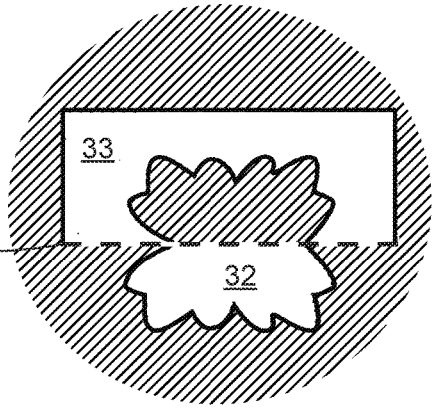

FIGS. 16A and 16B are plan views of the same positions shown in FIGS. 15A and 15B, but not in the same scale. The shaded area represents the surface upon which said Card is placed and shows the hollowed out area that is exposed when Inner Box Panel 32 is bent in opposition to Outer Box Ring 33. While the circumferential periphery edge can be optionally square or rectangular with linear lines, as shown in FIG. 3C, as shown in FIGS. 16A and 16B the circumferential edge periphery of the cardstock sheet can have curved, undulating non-linear lines in the form of all or part of the profile of a character associated with the business or greeting card.

In the alternate optional embodiment, where instead of the edge periphery of the card having curved lines imitating the profile of an iconic figure or character, the top panel of the card is a standard, rectangular card, as in FIG. 3C, the standing base is a custom base with an irregular surfaced inner portion.

Figure 17A:
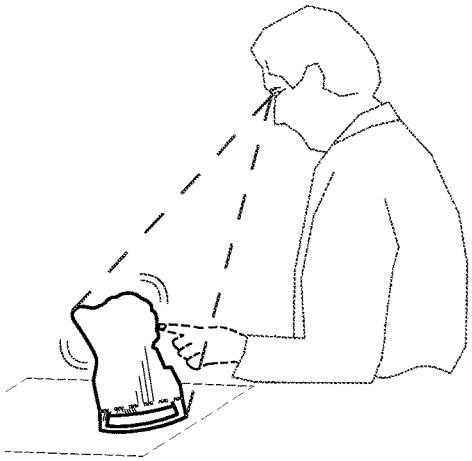
FIGS. 17A and 17B show the present invention in its intended use as a close-up advertising tool, whereby the display card has an optional arcuate bottom edge on each bottom base portion, to enable the card to be manually rocked in a back and forth or side to side motion by the user's finger or fingers, when the card is presented upon a horizontal support surface, within a visual line of sight of a viewer of the card.
Figure 17B:
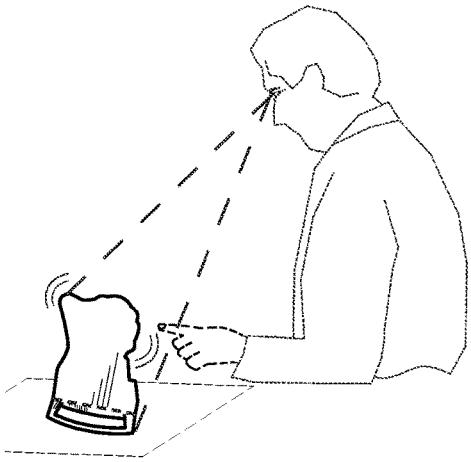

Arcuate Base Embodiment:

FIGS. 17A and 17B are perspective views of the deployment use of the present invention in its Arcuate Base embodiment, where the user's line of sight "V" in phantom lines directs the user to Card, and the user's hands rock the novelty card in an attractive oscillating side-to-side motion.

Figure 18A:
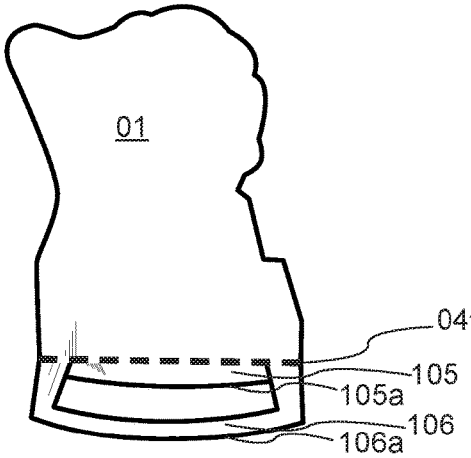
Figure 18C:
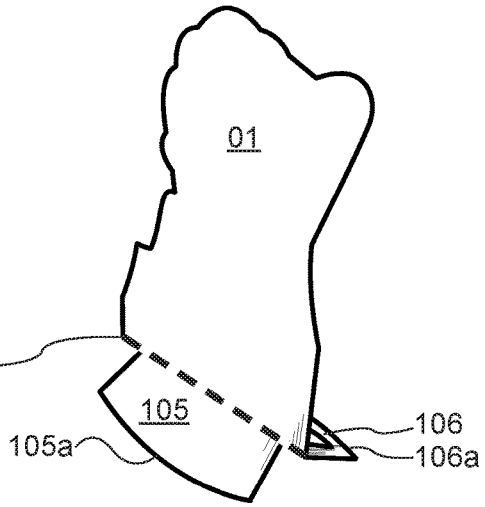
Figure 18B:
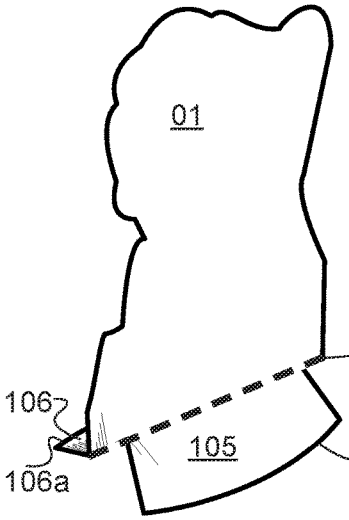
Figure 18D:
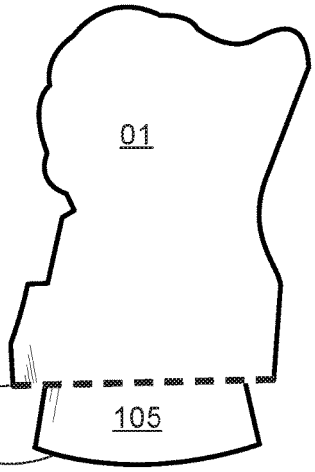

FIGS. 18A, 18B, 18C and 18D are perspective views that show the Card with a Display Panel 01, Arcuate Inner Box Support Leg 105, Arcuate Bottom Edge of Inner Box Support Leg 105*a*, Arcuate Outer Ring Support Leg 106 and Arcuate Bottom Edge of Outer Ring Support Leg 106*a*. Crease 04 is shown in the dashed line. FIG. 18A is the obverse side. FIG. 18D is the reverse side. FIGS. 18B and 18C are additional perspective views. These examples are shown as if the card's crease is bent to enable it to stand perpendicular to the surface on which it is placed.

Figures 19A, 19B:
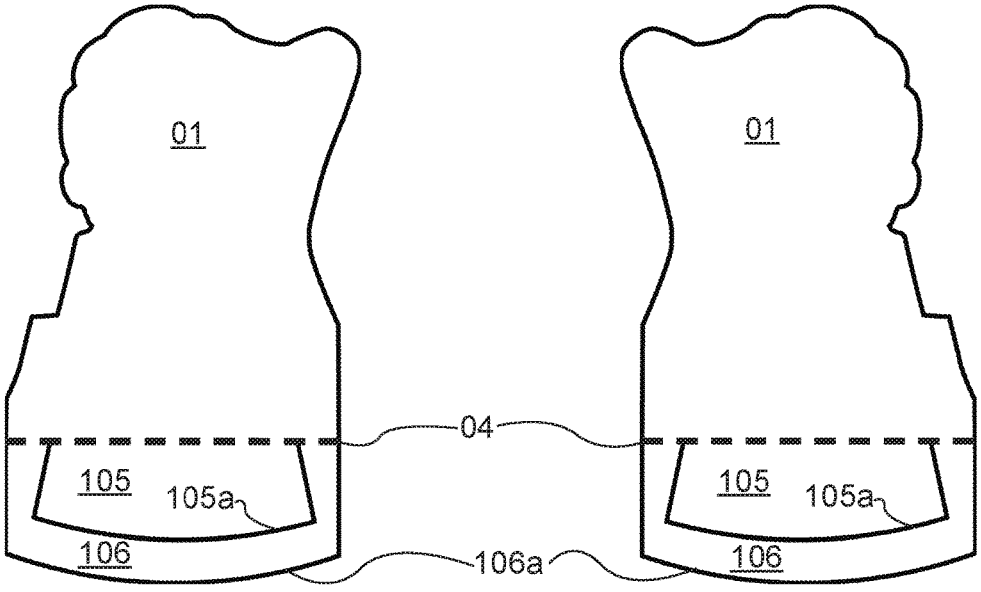

FIGS. 19A and 19B are shown as if laying flat, not folded or standing. FIG. 19A is the obverse side. FIG. 19B is the reverse side.

Figure 20A:
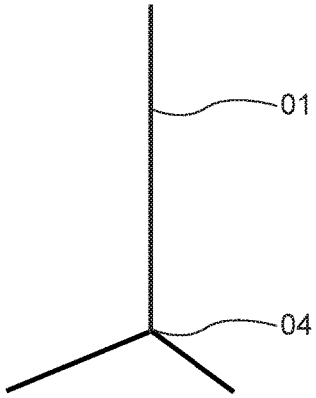
Figure 20B:
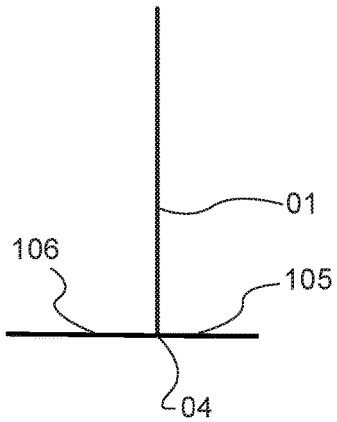

FIGS. 20A and 20B show elevation views of the card, with its crease folded at two different positions, both of which enable it to stand perpendicular to the surfaces on which it is placed. FIG. 20A shows the Card with the Base at the tallest position, with the Base parts bent at different angles from each other and Display Panel 01. In this position, the Card can be made to rock back and forth on Arcuate Bottom Edge of Inner Box Support Leg 105*a* and Arcuate Bottom Edge of Outer Ring Support Leg 106*a*.

FIG. 20B shows the Base at a lowest position, with the base parts bent at a 90 degree angle from Display Panel 01, perpendicular to Display Panel 01 and flat against the surface upon which said Card is displayed. In this position, the Card remains stationary.

Figure 21A:
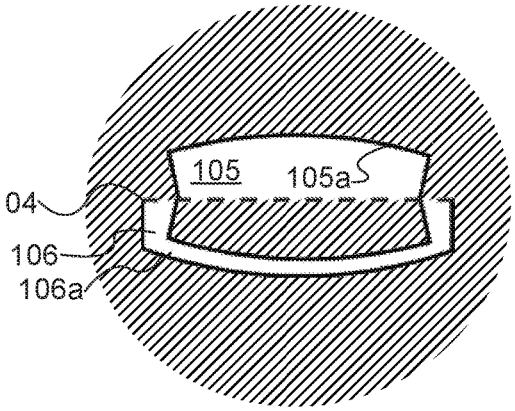
Figure 21B:
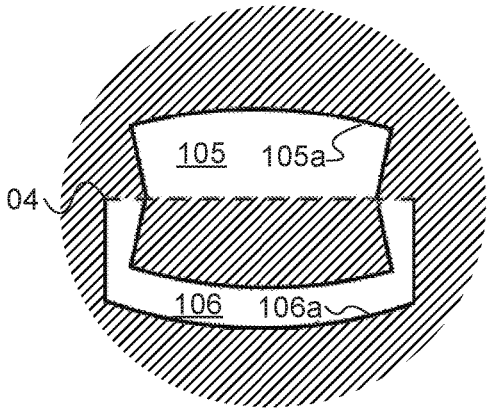

FIGS. 21A and 21B are plan views of the same positions shown in FIGS. 20A and 20B, but not in the same scale. The shaded area represents the surface upon which said Card is placed and shows the hollowed out area that is exposed when Arcuate Inner Box Support Leg 105 is bent in opposition to Arcuate Outer Ring Support Leg 106.

FIGS. 22A, 22B, 22C and 22D are perspective views that show the Card with a Display Panel 01, Arcuate Inner Box Support Leg 105, Arcuate Bottom Edge of Inner Box Support Leg 105*a*, Arcuate Outer Ring Support Leg 106 and Arcuate Bottom Edge of Outer Ring Support Leg 106*a*. Crease 04 is shown in the dashed line. FIG. 22A is the obverse side. FIG. 22C is the reverse side. FIGS. 22B and 22D are additional perspective views. These examples are shown as if the card's crease is bent to enable it to stand perpendicular to the surface on which it is placed. These drawings show a larger base section in proportion to the Display Panel 01.

While the circumferential periphery edge can be optionally square or rectangular with linear lines, as shown in FIG. 3C, in FIGS. 17A, 17B, 18A, 18B, 18C, 18D, 19A, 19B, 20A, 20B, 21A, 21B, 22A, 22B, 22C and 22C the circumferential edge periphery of the cardstock sheet can have curved, undulating non-linear lines in the form of all or part of the profile of a character associated with the business or greeting card, and where the base has an arcuate bottom edge to facilitate manual side to side rocking of the card, while deployed in the line of sight of the user.

FIGS. 22A, 22B, 22C and 22C show that the surface ratio of the lower base to the upper Display Panel 01 can vary, regardless of which base embodiment is used, where it is the arcuate bottom ring version of FIGS. 17A, 17B, 18A, 18B, 18C, 18D, 19A, 19B, 20A, 20B, 21A, 21B, 22A, 22B, 22C and 22C, or, alternatively, the other tripod base embodiment of FIGS. 2A, 2B, 2C, 2D, 3A, 3B, 4A, 4B, 4C, 5A, 5B and 5C, the box-in-box embodiment of Tripod Base embodiment of the invention with Optional Flange or Foot or the Custom Box embodiment of FIGS. 13A, 13B, 13C, 13D, 14A, 14B, 15A, 15B, 16A and 16B.

In the foregoing description, certain terms and visual depictions are used to illustrate the preferred embodiment. However, no unnecessary limitations are to be construed by the terms used or illustrations depicted, beyond what is shown in the prior art, since the terms and illustrations are exemplary only, and are not meant to limit the scope of the present invention.

It is further known that other modifications may be made to the present invention, without departing the scope of the invention, as noted in the appended Claims.

I claim:

1. A three dimensional business/greeting card/advertising display card for support in an upright perpendicular position on a horizontal surface comprising: a single sheet of semi-rigid, flexible material having an upper main display panel and a lower base panel;

both sides of said upper main display panel having an advertising display thereon;

a side-to-side extending pre-creased line separating said upper main display panel and said lower base panel;

a U-shaped slit extending down from said side-to-side extending pre-creased line in said lower base panel to allow folding said base panel along said side-to-side extending pre-creased line in opposing directions to enable said lower base panel to form legs for supporting on said horizontal surface said upper main display panel in said an upright perpendicular position, wherein both sides of said upper display panel are equally available for viewing, said legs consisting of a solid leg formed by and within said slit and a hollow leg surrounding said solid leg;

said legs having bottom edges which are arced in direct contact with said horizontal surface to permit said card to be rocked at the pleasure of a user;

said sheet of semi-rigid, flexible material being free of any adhesive which would prevent rocking motion of said card and having no removed portions within an external outer edge of said material capable of forming open apertures; and whereby said business/greeting card can be free standing in said upright perpendicular position on said horizontal surface within a line of sight of a viewer, said user being enabled to deploy said display card on a desk, counter or shelf without need to use adhesive tape, glue, construct an easel, attach external stands or fasteners.

2. The card of claim 1 in which said semi-rigid, flexible material is cardstock paper.

3. The card of claim 1 in which the semi-rigid, flexible material is selected from the group consisting of paper card stock made of wood fibers, natural and man made fibers, polyethylene, polypropylene, polyurethane or printable plastic sheet, and composite sheets comprising a plurality of flexible and rigid materials, or combinations thereof.

4. The card of claim 1 in which said upper main display has a circumferential edge peripheral shape of a person, an object of interest or an iconic image.

5. A method of creating and deploying a three dimensional business/greeting card/advertising display card comprising the steps of:

selecting a single sheet of semi-rigid, flexible material;

forming in said sheet an upper main display panel and a lower base panel by pre-creasing a side-to-side extending line separating said upper main display panel and said lower base panel;

said upper main display panel having an advertising display on both sides thereof;

forming a U-shaped slit extending down from said side-to-side extending pre-creased line in said lower base panel to form unfolded legs supporting said upper main display panel in an upright position, said sheet of semi-rigid, flexible material having no removed portions within an external outer edge of said material capable of forming open apertures, said legs consisting of a solid leg formed by and within said slit and a hollow leg surrounding said solid leg;

folding one of said legs in a forward direction and an other of said legs in a rearward direction to maintain said upper main display panel in a perpendicular position and having bottom edges of said legs in the form of an arc;

said bottom edges of said legs being continuously smooth from end to end of said legs;

a user placing said card on a horizontal surface with said bottom edges of said legs directly in contact with said horizontal surface;

said user rocking said card back and forth; and whereby said upper main display panel is within a line of sight of said user during rocking motion.

6. The method of claim 5 in which said semi-rigid, flexible material is cardstock paper.

7. The method of claim 5 further comprising the step of selecting said semi-rigid, flexible material from the group consisting of paper card stock made of wood fibers, natural and man made fibers, polyethylene, polypropylene, polyurethane or printable plastic sheet, and composite sheets comprising a plurality of flexible and rigid materials, or combinations thereof.

8. The method of claim 5 further comprising the steps of printing or imprinting said semi-rigid, flexible material using at least one of the following methods selected from the group consisting of: offset lithography, digital toner printing, xerography, ink jet printing, LED printing, silk screening using ink, paint or dyes, dye sublimation, photographic printing, foil stamping, foil or other imprinting, letterpress, debossing, embossing, laser etching, laser imprinting, laser burning, rubber die imprinting, hand inking, hand painting and ultraviolet coating, or combinations thereof.

9. The method of claim 5 further comprising the step of pre-creasing said semi-rigid, flexible material using at least one of the following technologies selected from the group consisting of manual creasing, hand creasing, cutting plotter, electric scoring machine, letterpress, die matrix on offset press, cylinder press, rotary die cutting, flexible die, micro-slitting and laser etching, or combinations thereof.

10. The method of claim 5 further comprising cutting said semi-rigid, flexible material to shape using one of the following technologies selected from the group consisting of hand cutting, digital contour cutting, cutting plotter, dinking, steel-rule die, letterpress, cylinder press, rotary die cutting, flexible die, rotary magnetic cylinder die cutting, laser cutting or extrusion, or combinations thereof.

11. The method of claim 5 further comprising circumferentially cutting a circumferential edge periphery of said upper main display panel into a configuration simulating a person or object of interest.

12. A method of creating and deploying a three dimensional business card on a horizontal surface comprising the steps of:

selecting a single sheet of card-stock material;

forming in said sheet an upper main display panel and a lower base panel by pre-creasing a side-to-side extending line separating said upper main display panel and said lower base panel;

said upper main display panel having an advertising display on both sides thereof;

forming a U-shaped slit extending into said lower base panel from said side-to-side extending pre-creased line to fold said sheet along said side-to-side extending pre-creased line to form legs supporting said upper main display panel in an upright position, said legs consisting of a solid leg formed by and within said slit and a hollow leg surrounding said solid leg, said sheet of semi-rigid, flexible material haying no removed portions within an external outer edge of said material capable of forming open apertures;

said legs extending respectively to a front and rear of said upper main display panel to maintain said upper main display panel in a perpendicular position;

both of said legs being extended down at respective angles where only an arcuate edge of a distal end of each leg contacts said horizontal surface;

placing said card with said distal ends of said legs contacting the horizontal surface so that said card is free standing and unattached to said horizontal surface; and whereby said upper main display panel of said business/greeting card stands upright in a perpendicular position to a horizontal surface within a line of sight of a viewer.

13. The method of claim 12 further comprising circumferentially cutting a circumferential edge periphery of said upper main display panel into a configuration simulating a person or object of interest.

14. The method of claim 12, wherein configuration of a circumferential edge periphery of said upper main display panel simulates a person or object of interest.

* * * * *